US006624834B2

(12) United States Patent
Takahashi

(10) Patent No.: US 6,624,834 B2
(45) Date of Patent: Sep. 23, 2003

(54) PRINTER DEVICE

(75) Inventor: Yasuo Takahashi, Fuchu (JP)

(73) Assignee: Olympus Optical Co., Ltd. (JP)

( * ) Notice: Subject to any disclaimer, the term of this patent is extended or adjusted under 35 U.S.C. 154(b) by 0 days.

(21) Appl. No.: 09/923,549

(22) Filed: Aug. 7, 2001

(65) Prior Publication Data

US 2002/0021348 A1 Feb. 21, 2002

(30) Foreign Application Priority Data

Aug. 21, 2000 (JP) ..... 2000-249925

(51) Int. Cl.[7] ..... B41J 2/32
(52) U.S. Cl. ..... 347/171
(58) Field of Search ..... 347/171, 174, 347/209, 211, 218, 189; 320/134; 358/412, 405, 437; 323/265; 713/310

(56) References Cited

U.S. PATENT DOCUMENTS 5,446,905 A * 8/1995 Koshiishi ..... 358/412
5,631,677 A * 5/1997 Horigome et al. ..... 320/134
5,690,437 A * 11/1997 Yanagisawa et al. ..... 347/189
5,748,327 A * 5/1998 Toyoda et al. ..... 323/265
5,958,056 A * 9/1999 Lehmann ..... 713/310
6,067,171 A * 5/2000 Yamada et al. ..... 358/405
6,285,467 B1 * 9/2001 Ezumi et al. ..... 358/437

FOREIGN PATENT DOCUMENTS

JP Hei6-11801 3/1994
JP 07-186432 7/1995
JP 3013042 12/1999

* cited by examiner

*Primary Examiner*—Lamson Nguyen
*Assistant Examiner*—K. Feggins
(74) *Attorney, Agent, or Firm*—Straub & Pokotylo; John C. Pokotylo

(57) ABSTRACT

If printing is commenced while a relay is supplying power supply voltage from a battery to a power supply controller, a control circuit outputs a power supply switching prohibition signal to a permission/prohibition circuit. Even if an AC adapter is connected during printing, the relay will not be switched by an ON signal from an input voltage determination circuit. Once the printing is completed, the power supply switching prohibition signal is stopped, and a switch is made to power supply input from the AC adapter. As a result, even if an AC power supply is connected during printing, this will not cause the printing to take a longer time, and will prevent a decrease in printing quality.

20 Claims, 6 Drawing Sheets

PRINTER DEVICE

This application claims benefit of Japanese Application No. 2000-249925 filed in Japan on Aug. 21, 2000, the contents of which are incorporated by this reference.

BACKGROUND OF THE INVENTION

1. Field of the Invention

The present invention relates to a printer device such as a sublimation type thermal transfer printer.

2. Description of the Related Art

Thermal transfer printer devices, with which the display of sharp, full-color images is possible, have become commonplace devices for making a hard copy from a video image stored in a personal computer or captured by a camera-integrated video tape recorder, an electronic still camera, or the like.

In a thermal transfer printer device, the recording paper is sandwiched under pressure along with an ink sheet between a platen roller and a thermal head. The ink sheet consists of a base film coated with a heat-sublimable dye, and is disposed such that the heat-sublimable dye is pressed against the recording paper. A plurality of heating elements are provided on one side of the thermal head, and when current is sent through the thermal head these heating elements generate heat according to the printed data, and heat the heat-sublimable dye via the base film. This results in the heat-sublimable dye being sublimated and transferred onto the recording sheet.

Portable printers must be made more useful by being operable even in places where no AC power supply is available. Specifically, it must be possible to drive a portable printer using only a battery as the power supply. When portability is emphasized, a battery with a relatively small capacity is employed.

Batteries run down as they are used, and the supply voltage gradually drops according to how run-down the battery is. Therefore, even with a portable printer, when an AC power supply is available, it can be used instead of the battery in order to reduce battery consumption and extend the service life of the battery. In view of this, the use of an AC power supply is generally given priority, and when the connector of the AC power supply is connected, the printer automatically switches from battery use to AC power supply use.

Meanwhile, the printing density on a recording paper is determined by the temperature of the heating elements. Specifically, the printing density can be easily varied by varying the amount of current supplied to the heating elements of the thermal head. A method employed for varying the amount of current flowing to the heating elements is to vary how long the current is allowed to flow to the heating elements (hereinafter referred to as the ON time).

This control of the ON time is performed by a CPU incorporated into the device. Since a relatively stable power supply voltage is obtained during the supply of power using an AC power supply, the CPU is able to control current flow without regard to fluctuations in the power supply voltage. In contrast, when a battery is used, the power supply voltage that is supplied varies according to the remaining charge of the battery, so the CPU must monitor the supply voltage and correct the ON time according to the monitoring results.

Japanese Patent No. 3,013,042 discloses a thermal printer device having two power supply inputs (a battery and an AC adapter), in which there is a component for distinguishing between the AC adapter input and battery input, and the internal resistance is set on the basis of a signal from this distinguishing component.

However, frequent monitoring of the supply voltage increases the load of the CPU and also makes printing take longer. Consequently, the supply voltage is generally only monitored when the power is turned on and prior to the start of printing, and the like.

The user, though, may plug in the connector of the AC power supply during printing in which the battery is being used as the power supply. If this happens, the power supply will be switched from the battery to the AC power supply, which may result in a change from the low supply voltage of the discharged battery to the high supply voltage of the AC power supply. Specifically, the current flowing to the heating elements rises, there is a sudden change in the printing density, and print quality suffers.

Conversely, it is also conceivable that the user may unplug the connector of the AC power supply in the midst of printing in which the AC power supply is being used as the power supply. If this happens, the power supply will switch to the battery, the lower supply voltage of the discharged battery will decrease the amount of current flowing to the heating elements, there will be a sudden change in the printing density, and print quality will again suffer.

Good print quality can be maintained if the sequence of monitoring the supply voltage is carried out frequently and the ON time is varied according to the monitoring results, but in this case printing takes longer, as mentioned above.

SUMMARY OF THE INVENTION

It is an object of the present invention to provide a printer device with which a decrease in print quality can be prevented, without leading to a longer printing time, by making it possible to prohibit switching from a power supply using the battery to a power supply using an AC power supply in the midst of printing.

The printer device of the present invention comprises a thermal head which prints images on paper on the basis of image data, a power supply switching component which switches a power supply input from a battery power supply and an AC adapter and applies this input to the thermal head, and a controller which, once a print operation with the thermal head has been commenced by switching the power supply switching component so that electrical power supplied from the battery power supply is applied to the thermal head, prohibits the switching of the power supply input by the power supply switching component until the print operation is completed, even if the AC adapter is connected in the midst of the printing of one page.

Also, the printer device of the present invention comprises a thermal head which prints images on paper on the basis of image data, a power supply switching component which switches a power supply input from a battery power supply and an AC adapter and applies this input to the thermal head, and a controller which, once a print operation with the thermal head has been commenced by switching the power supply switching component so that electrical power supplied from the battery power supply is applied to the thermal head, controls the power supply switching component such that the power supply input is switched from the battery power supply to the AC adapter upon completion of the print operation, if the AC adapter is connected in the midst of the printing of one page.

Other features and advantages of the present invention should become clear from the following description.

DESCRIPTION OF THE PREFERRED EMBODIMENTS

Figure 1:
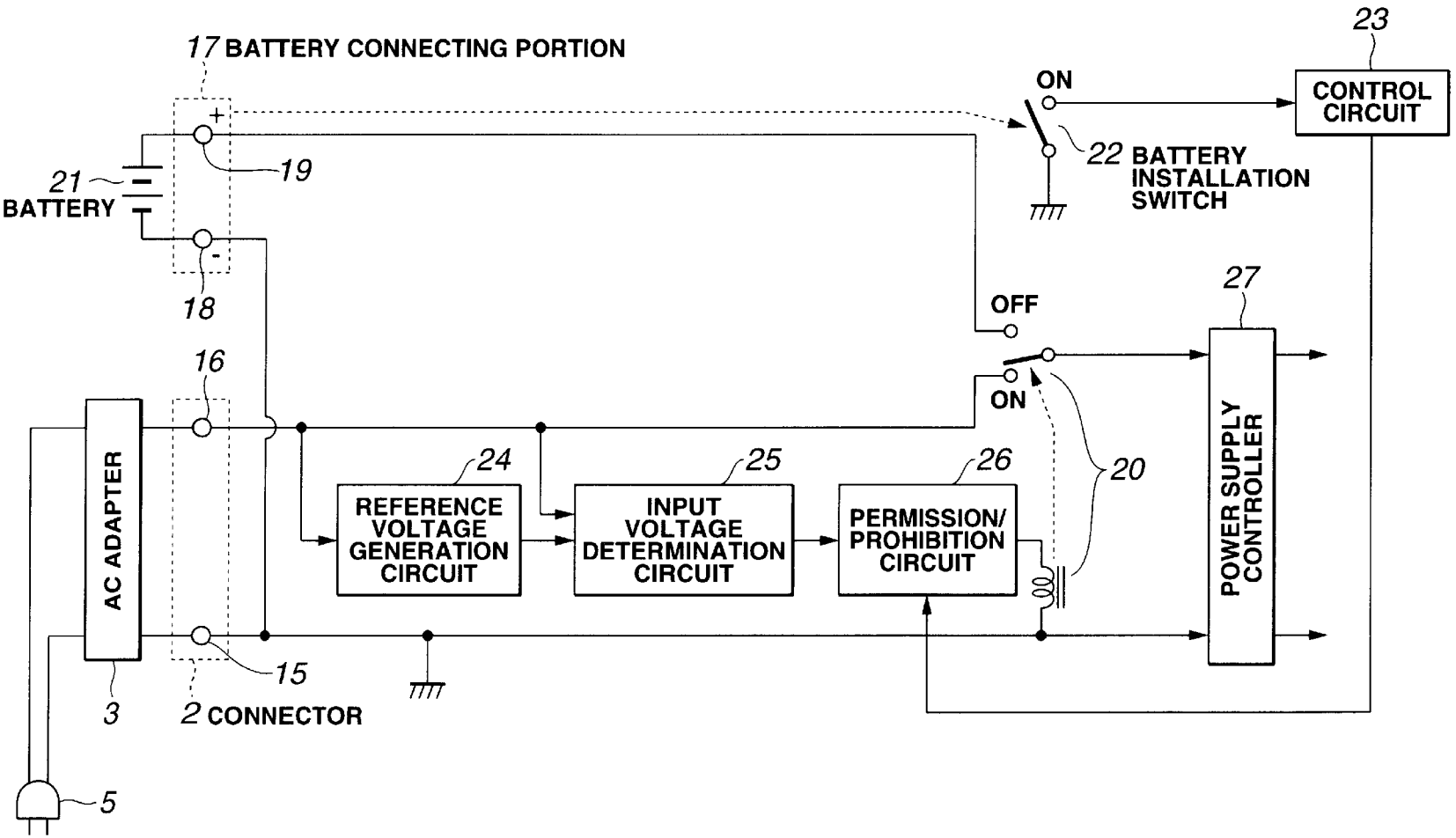
FIG. 1 is a circuit diagram illustrating the power supply switching circuit portion employed in the printer device pertaining to a first embodiment of the present invention.

Embodiments of the present invention will now be described in detail referring to the drawings. FIG. 1 is a circuit diagram illustrating the power supply switching circuit portion employed in the printer device pertaining to the first embodiment of the present invention, and FIGS. 2 and 3 are diagrams illustrating the AC adapter and the appearance of the device.

Figure 2:
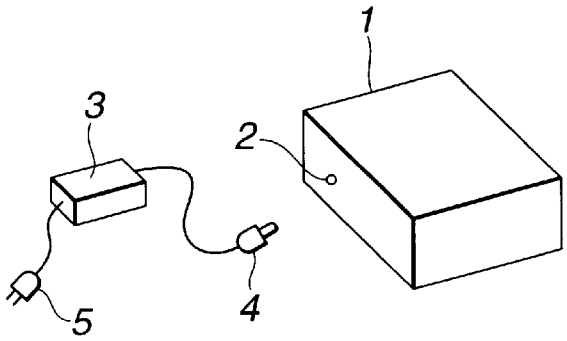
FIG. 2 is a diagram illustrating the AC adapter and the appearance of the device.
Figure 3:
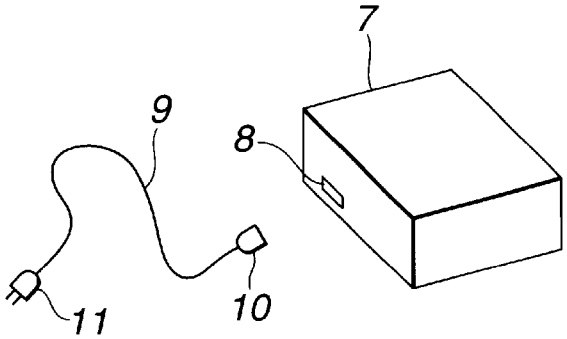
FIG. 3 is a diagram illustrating the AC adapter and the appearance of the device.

In FIG. 2, a printer housing 1 incorporates the power supply switching component shown in FIG. 1, as well as a recording paper feed mechanism, thermal head, power supply board, control board, and the like (not shown) therein. A plurality of heating elements that constitute dots are arranged on the thermal head (not shown). During printing, the thermal head is pressed against a platen roller (not shown) in a state in which a recording paper and an ink sheet (not shown) are sandwiched between the thermal head and the platen roller. The heating elements are pressed against the recording paper via the ink sheet.

The heating elements generate heat when power supply voltage is supplied from the power supply controller 27 in FIG. 1, described below. The plurality of heating elements are each provided with a switching element (not shown), and the supply of power supply voltage to the heating elements is controlled by turning the switching elements on and off. Specifically, the heating elements generate heat when current flows through them, heat and sublimate the heat-sublimable dye on the ink sheet, and cause this dye to be transferred onto the recording paper.

The power supply voltage is supplied from an AC adapter 3 or a battery 21 to the power supply controller 27 on the power supply board. In FIG. 2, a connector 2 is provided to the printer housing 1, allowing a plug 4 of the AC adapter 3 to be inserted into the connector 2. The AC adapter 3 has a plug 5 that is inserted into a commercial power supply outlet (not shown), whereupon the commercial power supply voltage is supplied to generate a DC voltage. The power supply voltage generated by the AC adapter 3 is supplied from the plug 4 to the connector 2.

In FIG. 1, one terminal 15 of the connector 2 is connected to a reference potential point, and the other terminal 16 is connected to the ON terminal of a relay 20. Meanwhile, a battery connecting portion 17 (not shown in FIG. 2) is exposed on the printer housing 1. This battery connecting portion 17 is constituted such that a battery 21 can be mounted. As a result, the negative terminal of the battery 21 is connected to a terminal 18 of the battery connecting portion 17, and the positive terminal of the battery 21 is connected to a terminal 19. The terminal 18 of the battery connecting portion 17 is connected to the reference potential point, and the terminal 19 is connected to the OFF terminal of the relay 20.

DC voltage from the battery 21 or DC voltage from the AC adapter 3 is supplied to the OFF or ON terminal, respectively, of the relay 20. The power supply controller 27 receives DC voltage from the ON or OFF terminal of the relay 20, and generates the power supply voltage needed for the various components.

In this embodiment, the power supply voltage applied from the power supply controller 27 to the thermal head is set relatively low, such as to a voltage of 7.2 V, and the resistance of the heating elements is set to a relatively small value, such as 660 Ω to 750 Ω.

Two important parameters in a thermal printer are how to set the maximum density E during printing and how long to send current to the head. The maximum printing density E is predetermined as a specific value.

If the ON time takes longer, sufficient printing density will be obtained even when a small current flows to the heating elements, but printing will take longer. In the case of a color printer, the print operation is respectively carried out for, e.g., four colors of ink (Y, M, C, and BK), so the print operation must be performed four times for a single page. Therefore, increasing the ON time is not an attractive option because the printing will take so long as to be impractical. For this reason, the amount of current flowing to the heating elements is increased in this embodiment in order to set the ON time short. Since the amount of current flowing to the heating elements is increased, no diode or the like is provided on the current path to lower voltage. In this embodiment, the relay 20 is employed as the power supply switching circuit, rather than employing a structure that makes use of a diode or FET.

Also, with portability in mind, no DC—DC converter is used. In this embodiment, the power supply voltage from the battery 21 is supplied directly to the heating elements, without being boosted first. Therefore, a battery capable of generating the power supply voltage supplied to the thermal head is used as the battery 21. For example, a nickel-hydrogen rechargeable battery with a large current capacity is used as the battery 21. For example, six nickel-hydrogen cells of 1.2 V each can be connected serially to create a 7.2 V battery 21. This allows the battery 21 to be relatively small, and satisfies the requirement that the device be portable.

A lithium ion rechargeable battery is advantageous in terms of portability because it has a voltage of 3.6 V per cell, but is unsuited to a thermal head that requires a large current because the high internal resistance means that only a small amount of current can be taken off per unit of time.

The resistance of the heating elements is suitably set so that sufficient current can be supplied to the heating elements and printing can be accomplished in a shorter ON time even when the power supply voltage is a low 7.2 V. In an ordinary printer in which the ON time has been shortened, heating elements with a resistance of 7 kΩ are used and a voltage of 22 V is applied, or heating elements with a resistance of 10 kΩ are used and a voltage of 28 V is applied. In this embodiment, the resistance is set such that the amount of energy applied to the thermal head will be equivalent to that of an ordinary printer in which the ON time has been shortened. Specifically, as described above, if a voltage of 7.2 V is applied to the heating elements, the resistance is set to, for example, from 660 Ω to 750 Ω.

In order for the print quality to be the same when the battery 21 is used as when the AC adapter 3 is used, the DC voltage generated by the AC adapter 3 is made the same as the voltage that can be generated by the battery 21. Since the DC voltage of the AC adapter 3 is substantially the same as the DC voltage of the battery 21, this is another reason why in this embodiment the relay 20 is used rather than a diode as the power supply switching circuit.

In FIG. 1, the voltage of the terminal 19 of the battery connecting portion 17 is supplied to the control terminal of a battery installation switch 22. The battery installation switch 22 supplies a mounted signal to the control circuit 23 only when the battery 21 is mounted to the battery connecting portion 17 so that the power supply voltage of the battery 21 is supplied to the control terminal.

The control circuit 23 controls the various components such as the circuit components on the control board and the power supply board (not shown). The control circuit 23 outputs a power supply switching prohibition signal, to a permission/prohibition circuit 26, to prohibit the switching of the selection of whether to use an AC power supply or the battery 21 as the power supply.

A positive polarity power supply voltage is applied from the AC adapter 3 to the terminal 16, and the power supply voltage applied to the terminal 16 is supplied not only to the ON terminal of the relay 20, but also to a reference voltage generation circuit 24 and an input voltage determination circuit 25.

When the plug 4 of the AC adapter 3 is connected to the connector 2, DC voltage is supplied through the terminal 16, and the reference voltage generation circuit 24 generates a certain reference voltage and outputs it to the input voltage determination circuit 25.

The input voltage determination circuit 25 compares this reference voltage to the voltage applied to the terminal 16. As a result, when the plug 4 of the AC adapter 3 is connected to the connector 2 and the DC voltage generated by the AC adapter 3 is supplied to the terminal 16 (hereinafter referred to as when the AC adapter 3 is connected), the input voltage determination circuit 25 outputs to the permission/prohibition circuit 26 an ON signal that is a determination result indicating that power supply voltage is being supplied by the AC adapter 3, and when the DC voltage generated in the AC adapter 3 is not being supplied to the terminal 16 (hereinafter referred to as when the AC adapter 3 is not connected), the input voltage determination circuit 25 outputs to the permission/prohibition circuit 26 an OFF that is a determination result indicating that power supply voltage in the AC adapter 3 is not being supplied.

The permission/prohibition circuit 26 selects the ON terminal for the relay 20 if there is an ON signal from the input voltage determination circuit 25, and selects the OFF terminal for the relay 20 if there is an OFF signal. As a result, when the AC adapter 3 is connected, DC voltage is supplied preferentially from the AC adapter 3, rather than the battery 21, to the power supply controller 27, which keeps the battery 21 from being run down further.

The AC adapter 3 is able to supply a constant voltage such as 7.2 V etc. In contrast, the supply voltage from the battery 21 steadily decreases from 7.2 V as the battery runs down. In view of this, the control circuit 23 performs a battery check of the battery 21 using a measurement apparatus (not shown), and if the voltage is below a predetermined level (e.g., 6 V), a determination is made that it is impossible to print using the battery 21 as the power supply. In this case, the control circuit 23 uses a display device (not shown) or the like to display a warning to the user indicating that the battery is insufficiently charged.

It is also possible, however, for printing to be performed if the battery check reveals the supply voltage from the battery 21 to be higher than a predetermined voltage level, such as 6.1 V. In this case, the control circuit 23 controls the print time of the thermal head (the ON time of the heating elements) according to the voltage value of the battery 21 so as to ensure the desired printing density.

Even when a print operation is commenced in the settings as above, the input voltage determination circuit 25 outputs an ON signal if the AC adapter 3 is connected in the midst of the print operation. If the relay 20 should be actuated by this ON signal and the power supply voltage from the AC adapter 3 supplied to the power supply controller 27, the voltage supplied to the heating elements will abruptly change from the 6.1 V level up to that point to 7.2 V.

Here again, there is no problem as long as the control circuit 23 varies the control of the ON time in response to changes in voltage. In a heat-sublimation type of color printer, however, paper feed and the print operation must be repeated four times using four colors of ink (Y, M, C, and BK), so for the control circuit 23 to control the ON time in response to changes in the voltage, the sequence for monitoring the supply voltage must be performed very frequently, and this leads to a longer printing time.

For this reason, in this embodiment the control circuit 23 performs a battery check only at the start of a print operation, and controls current flow by utilizing this check result. That is, the control circuit 23 does not change the setting of the current flow at the start of a print operation until the print operation has been completed for one page.

In this embodiment, if DC voltage from the AC adapter 3 is supplied during printing, a change in the connection state of the relay 20 which supplies DC voltage to the power supply controller 27, is prohibited so that there will be no change in the power supply voltage applied to the heating elements, in order to prevent pronounced changes in the printing density.

In this embodiment, the control circuit 23 outputs to the permission/prohibition circuit 26 a power supply switching prohibition signal that prohibits the power supply from being switched over to the AC adapter 3 from the start until the end of printing. When a power supply switching prohibition signal has been inputted by the control circuit 23, the permission/prohibition circuit 26 keeps the current status of the relay 20 (in which the OFF terminal is selected) even if the output of the input voltage determination circuit 25 changes from an OFF signal C to an ON signal.

The AC adapter 3 may also be incorporated into the printer housing. FIG. 3 is an explanatory diagram illustrating the appearance in this case.

In FIG. 3, an AC adapter (not shown) the same as the AC adapter 3 is incorporated into a printer housing 7 in addition to the structure in the printer housing 1 of FIG. 2. A plug 11 of a cable 9 is connected to the outlet of a commercial power supply (not shown), and a plug 10 is inserted into a connector 8 provided to the printer housing 7, allowing a DC power supply voltage to be obtained from the AC adapter incorporated into the printer housing 7.

In this case, the positive terminal of the AC adapter incorporated within the housing is connected to the ON terminal of the relay 20, the reference voltage generation circuit 24, and the input voltage determination circuit 25, while the negative terminal is connected to a reference potential point.

Next, the operation in an embodiment with the above structure will be described referring to the flow chart in FIG. 4.

Figure 4:
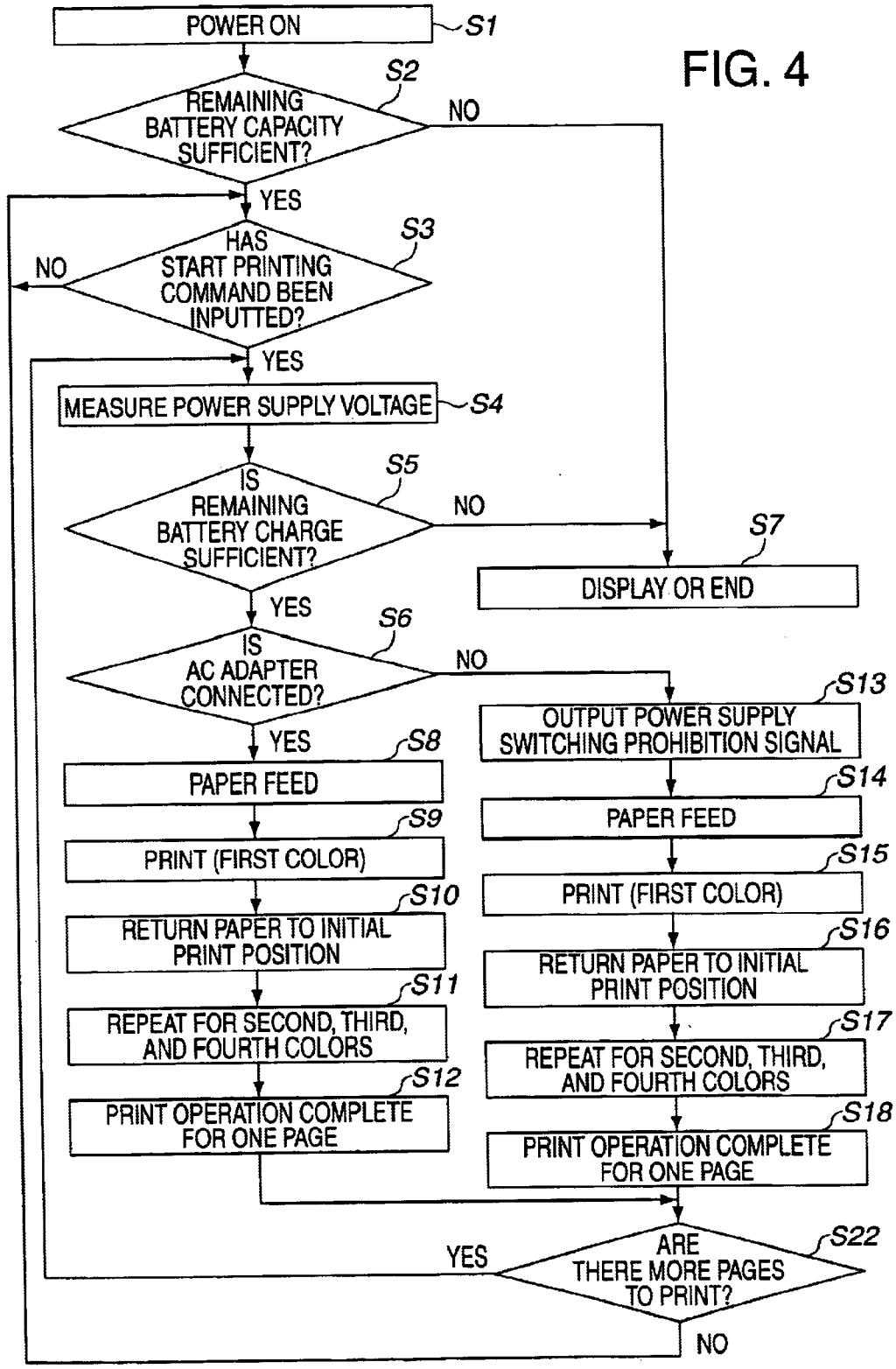
FIG. 4 is a flow chart illustrating the operation in the first embodiment.

When the power supply is turned on in step S1 in FIG. 4, the control circuit 23 performs a battery check in step S2 prior to printing. The battery installation switch 22 is switched ON when the battery 21 is installed in the battery connecting portion 17. This allows the control circuit 23 to recognize that the battery 21 has been installed and perform a battery check. The control circuit 23 measures the output voltage of the battery 21 and determines whether the remaining capacity is sufficient for printing.

If it is determined in the battery check of step S2 that the remaining capacity of the battery 21 is insufficient for printing, in step S7 the control circuit 23 either performs end processing or performs display processing indicating that the battery capacity is too low. The control circuit 23 may also perform audio notification along with or instead of the display processing.

If it is determined in the battery check of step S2 that the remaining capacity of the battery 21 is sufficient for printing, the method proceeds to step S3. In step S3, the control circuit 23 is in a standby mode in which it waits for input directing a start of printing. When a start printing command is inputted, the control circuit 23 measures the power supply voltage (step S4) supplied from the power supply controller 27. Sufficient power supply voltage will always be obtained if the power supply voltage is being supplied by the AC adapter 3, but when the power supply voltage is being supplied by the battery 21, the battery may not have sufficient remaining capacity for printing, depending on how run down the battery is. If it is determined in the next step 55 that the remaining battery capacity is insufficient, then in step 57 the control circuit 23 either performs end processing or performs display processing indicating that the battery capacity is too low.

Meanwhile, when the power supply voltage is being supplied from the AC adapter 3, or when the battery 21 still has sufficient capacity for printing to be performed, the control circuit 23 sets various parameters such as the ON time according to the result of measuring the power supply voltage.

If the power supply voltage is being supplied from the AC adapter 3, or if the battery 21 still has sufficient capacity, then a determination is made in the next step S6 whether the power supply voltage is being supplied by the AC adapter 3.

Let us assume here that the plug 5 of the AC adapter 3 is connected to an outlet of a commercial power supply, and the plug 4 is connected to the connector 2. In this case, the power supply voltage of the AC adapter 3 is supplied to the ON terminal of the relay 20, and is also supplied to the reference voltage generation circuit 24 and the input voltage determination circuit 25. The reference voltage generation circuit 24 generates a reference voltage from the output DC voltage of the AC adapter 3, and the input voltage determination circuit 25 determines that the power supply voltage is being supplied from the AC adapter 3 by a comparison between the reference voltage and the voltage at the terminal 16. As a result, the input voltage determination circuit 25 supplies an ON signal to the relay 20 via the permission/prohibition circuit 26, and the relay 20 supplies to the power supply controller 27 the power supply voltage from the AC adapter 3 supplied to the ON terminal.

The power supply controller 27 supplies a stable 7.2 V of power supply voltage from the AC adapter 3 directly to the heating elements of the thermal head. Meanwhile, feeding operation of paper is carried out by the control circuit 23 in step S8. The recording paper is conveyed while the heating elements of the thermal head are pressed against the platen roller in the state in which the ink ribbon and recording paper are sandwiched between the thermal head and the platen roller.

Then, the control circuit 23 begins the printing of the first color in step S9. That is, the control circuit 23 drives transistors that control which of the heating elements are powered on the basis of print data, and current flows from the power supply controller 27 to those heating elements.

The power supply voltage from the power supply controller 27 is applied to those heating elements connected to ON transistors. As a result, the ON heating elements generate heat, and the heat-sublimable dye coating the ink ribbon is sublimated and transferred to the recording paper. Thus, the heat-sublimable dye is transferred at a print density corresponding to the print data.

When printing has been performed by the heating elements for a predetermined number of lines in the recording paper width direction, the recording paper and ink ribbon are moved forward, and printing is performed for the next predetermined number of lines. Printing is accomplished by subsequently repeating the printing by the thermal head and the conveyance of the recording paper and ink ribbon in the same fashion.

Once the recording of the first color (such as cyan) is completed, the control circuit 23 in step S10 moves the recording paper to the same position where the recording of the first color began. Then, in step S11, the ink ribbon is moved to a position where the second color (such as yellow) can be transferred, and the second color printing is carried out in the same manner as for the first color. The other colors are subsequently printed in the same fashion until printing is completed (step S12).

In step S22, a determination is made whether continuous printing has been instructed (e.g., whether A there are more pages to print), and if it has, the flow returns to step S4 and the same processing is repeated, but if it has not, the flow returns to step S3 and a standby mode in which a start printing command from the user is awaited.

Let us next assume that it is determined in step S6 that the AC adapter 3 is not connected. In this case, the input voltage determination circuit 25 outputs an OFF signal. This OFF signal is supplied to the relay 20 via the permission/prohibition circuit 26, and the relay 20 selects the OFF terminal. Thus, in this case the power supply voltage from the battery 21 is supplied to the power supply controller 27.

Thus, whether the power supply voltage is supplied from the AC adapter 3 is determined by the input voltage determination circuit 25, and the switching of the power supply is performed by controlling the relay 20 according to the determination result.

So that, even if the DC voltage generated by the battery 21 is roughly the same as the DC voltage generated by the AC adapter, switching of the power supply can be controlled.

The power supply controller 27 directly supplies the heating elements of the thermal head with the power supply voltage of the battery 21 inputted via the OFF terminal of the relay 20. In this case, since no element that lowers the voltage, such as a diode, is interposed in the current path up to the heating elements, a large current can flow efficiently to the heating elements. As a result, the resistance of the heating elements can be lowered and a large current made to flow even at a relatively low power supply voltage, and this shortens the printing time.

If it is determined in step S6 that the AC adapter 3 is not connected, the control circuit 23 outputs a power supply switching prohibition signal (step S13). This power supply switching prohibition signal is supplied to the permission/prohibition circuit 26, and the permission/prohibition circuit 26 stops (fixes) the switching operation of the relay 20. That is, the power supply voltage continues to be supplied from the battery 21 to the power supply controller 27 during the time that the power supply switching prohibition signal is outputted.

Next, the print processing of steps S14 to S18 are performed. The print processing of these steps S14 to S18 is the same as the print processing in steps S8 to S12. The determination in step S22 is then made.

Thus, in this embodiment, even if the AC adapter 3 is connected in the midst of printing using the battery 21, switching operation of the relay 20 is prohibited by the power supply switching prohibition signal, preventing sudden fluctuation in the power supply voltage during printing, keeping the print density constant, and preventing any decrease in print quality.

Figure 5:
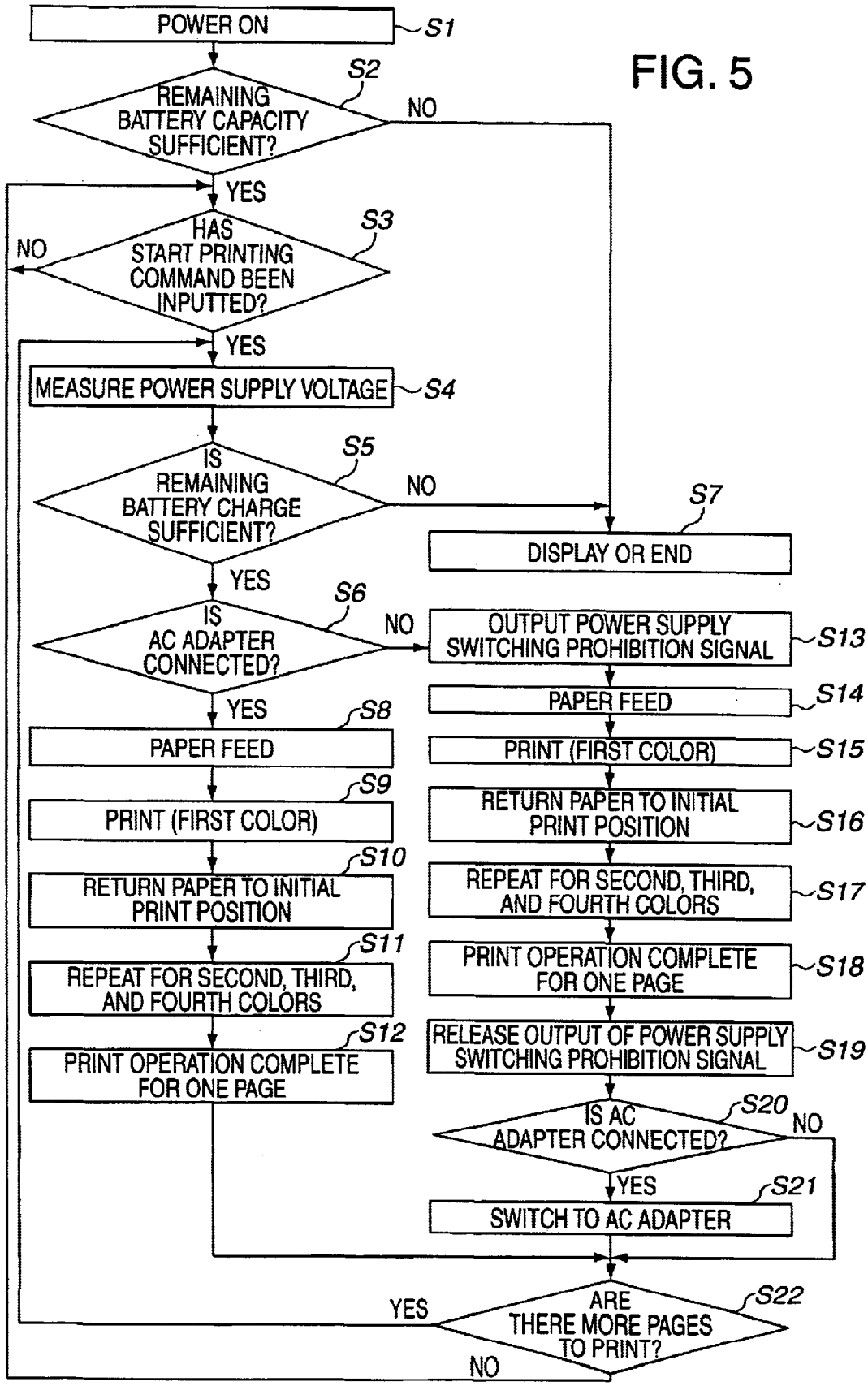
FIG. 5 is a flow chart illustrating the operation flow employed in a second embodiment of the present invention.

FIG. 5 is a flow chart illustrating the operation flow employed in a second embodiment of the present invention. In FIG. 5, those steps that are the same as in FIG. 4 are labeled the same and their description will be omitted.

In the first embodiment, printing with the battery was performed until all of the printing was completed in the case of continuous printing in which a plurality of pages were printed continuously using the battery as the power supply. When battery life and other factors are taken into account, however, it might be better to switch the power supply from the battery to the AC adapter 3 in between printing operations. This second embodiment makes this switch possible.

The hardware structure in this embodiment is the same as in FIG. 1.

The processing from turning on the power until the completion of the print operation for one page (steps S1 to S18) is the same as that in FIG. 4. In this second embodiment, once the print processing for one page is completed, the control circuit 23 stops the output of the power supply switching prohibition signal in step S19. When the control circuit 23 stops it, the permission/prohibition circuit 26 applies the output of the input voltage determination circuit 25 to the relay 20, which enables power supply switching operation.

Then, in step S20, the input voltage determination circuit 25 determines whether the AC adapter 3 is connected, and if it is connected, the ON terminal is selected for the relay 20 in step S21. As a result, the power supply is switched to the AC adapter 3 upon completion of the print operation of one page when the AC adapter 3 is connected in the midst of printing and the like.

Then, in step S22, a determination is made whether continuous printing has been instructed, and if it has, the flow returns to step S4 and the same processing is repeated, but if it has not, the flow returns to step S3 and a standby mode in which a start printing command from the user is awaited.

Thus, in this embodiment, the same effect as in the first embodiment is obtained, and when continuous printing has been instructed, there is the further advantage that the AC adapter 3 can be connected after each page has been printed, which allows the life of the battery 21 to be extended without adversely affecting print quality.

In the first and second embodiments, power supply switching prohibition was controlled for a case in which the AC adapter 3 was connected in the midst of printing using the battery 21. Conversely, it is also conceivable that the plug of the AC adapter 3 may be unplugged from the connector in the midst of printing in which the power supply from the AC adapter 3 is being used. If this happens, the supply of power supply voltage to the power supply controller 27 will be interrupted if switching of the power supply by the relay 20 is prohibited. For this reason, in the first and second embodiments, no power supply switching prohibition signal is generated during printing using the AC adapter 3.

However, if the power supply is switched from the AC adapter 3 to the battery 21 in the midst of printing, there is the possibility of a marked change in the print density. To prevent this, some means is needed for preserving the supply state of the power supply voltage from the AC adapter 3 during printing.

Figure 6:
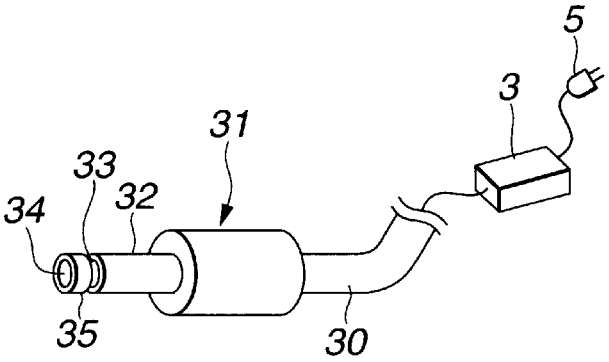
FIG. 6 is an oblique view of the structure on the AC adapter side in a third embodiment of the present invention.
Figure 7:
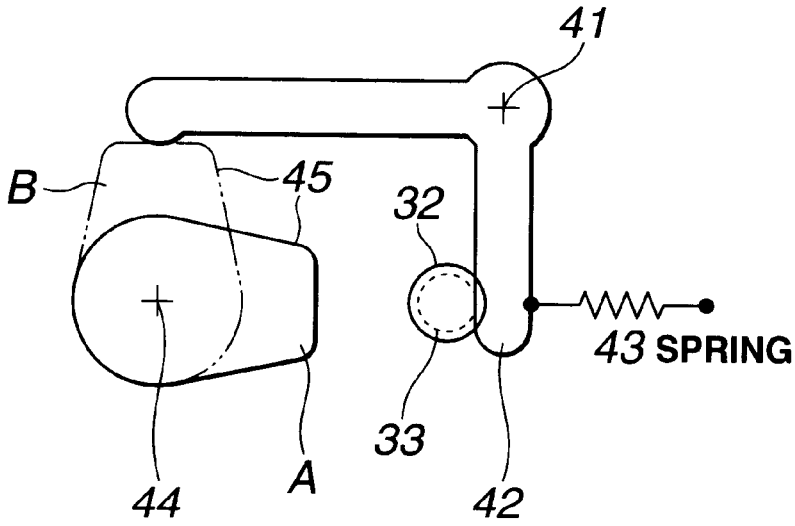
FIG. 7 is an oblique view of the structure on the connector side in the third embodiment of the present invention.

FIGS. 6 and 7 pertain to a third embodiment of the present invention, and illustrate a locking mechanism for thus preserving the supply state of the power supply voltage from the AC adapter 3. FIG. 6 is an oblique view of the structure on the AC adapter side. FIG. 7 is an explanatory diagram of the structure on the connector side.

In FIG. 6, the AC adapter 3 is constituted such that a commercial power supply voltage will be supplied when the plug 5 is connected to an outlet of a commercial power supply (not shown), and this commercial power supply voltage is converted into a DC voltage such as 7.2 V. The DC voltage generated by the AC adapter 3 is transmitted to a plug 31 via a cable 30.

A cylindrical contact component 32 is formed at the tip of the plug 31. A positive contact 34 is formed on the inner circumference side of the contact component 32, while a negative contact 35 is formed on the outer circumference side, and the DC voltage from the AC adapter 3 is generated between these contacts 34 and 35.

Meanwhile, a connector (not shown) into which the contact component 32 of the plug 31 can be inserted is provided to the printer housing. This connector has a negative receiver that is formed in a cylindrical shape and into which the negative contact 35 is fitted, and a positive receiver that is formed in a rod shape on the inside of this cylindrical negative receiver and that is in contact with the positive contact 34. These positive and negative receivers correspond to the terminals 16 and 15 in FIG. 1, respectively.

In this embodiment, a groove-shaped recess 33 is formed on the outer circumference of the contact component 32 of the plug 31. Meanwhile, as shown in FIG. 7, an L-shaped latch 42 that swingably pivots on an axis 41 is provided in the printer housing. One end of the latch 42 is disposed near the tip of the plug 31 inserted in the connector. This end is formed in a shape that fits into the recess 33 in the plug 31, and is urged away from the plug 31 by a spring 43.

The other end of the latch 42 is disposed near a cam 45 that swings around an axis 44. The cam 45 swings in conjunction with a head cam (not shown) for moving the thermal head (not shown). The thermal head is constituted to move to different positions during printing and during other times, and the head cam linked to the cam 45 is driven by a motor (not shown) according to an operation mode, so that a thermal head arm (not shown) is pushed by this cam face, and the thermal head is moved.

Except during printing, the cam 45 is in a state A in FIG. 7, and is in a state B indicated by the two-dot chain line in FIG. 7 during printing. In a state in which the plug 31 is inserted into the connector (not shown), when the cam 45 is in state B in FIG. 7, the other end of the latch 42 is pushed by the cam face of the cam 45, while one end of the latch 42 rotates and is fitted into the recess 33 in the plug 31. Thereby, the plug 31 is fixed in the insertion direction by the latch 42, so that it cannot be unplugged from the connector (not shown).

In a state in which the plug 31 is not inserted in the connector (not shown), when the cam 45 is in state B in FIG. 7, the other end of the latch 42 is pushed by the cam face of the cam 45, while one end of the latch 42 is positioned so as to obstruct part of the forward path of the plug 31 when plugged into the connector. As a result, the plug 31 cannot be completely inserted into the connector (not shown).

That is, in this embodiment, the plug 31 cannot be inserted into the connector during printing, nor can the plug 31 be unplugged from the connector during printing.

The power supply voltage from the AC adapter 3 is supplied to the power supply controller 27 preferentially over the power supply voltage from the battery 21 (see FIG. 1), and the power supply controller 27 supplies the inputted power supply voltage directly to the heating elements of the thermal head, which is the same as in the first embodiment.

In an embodiment structured as above, at the start of printing the latch 42 is rotated by the cam 45. If the plug 31 is inserted prior to printing, the latch 42 fits into the recess 33 in the plug 31, but if the plug 31 is not inserted prior to printing, the latch 42 obstructs part of the forward path of the plug 31.

As a result, insertion and removal of the plug 31 is prohibited once printing has begun. Therefore, a print operation is performed by the power supply voltage from the AC adapter 3 when the plug 31 has been inserted prior to the start of printing, but the print operation is performed by the power supply voltage from the battery 21 when the plug 31 has not been inserted prior to the start of printing. Because only the voltage generated by the AC adapter 3, or only the voltage generated by the battery 21, is used from the start to the end of printing, it is possible to prevent marked changes in print density and the resulting drop in print quality.

Figure 8:
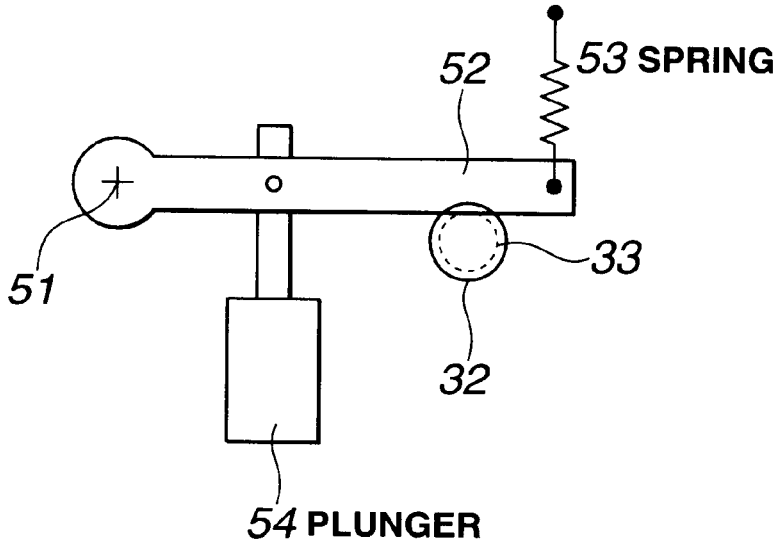
FIG. 8 is an oblique view of the structure on the connector side in a fourth embodiment of the present invention.

FIG. 8 pertains to a fourth embodiment of the present invention, and is an explanatory diagram of the structure on the connector side. In the third embodiment shown in FIG. 7, the plug 31 can not only not be removed during printing but also not be inserted. When continuous printing and the like are taken into consideration, however, it might be better to make it possible to insert the plug 31 during printing. This embodiment is applied to this situation.

The structure on the AC adapter in this embodiment is the same as in FIG. 6. As shown in FIG. 8, a latch 52 that swingably pivots at an axis 51 is provided in the printer housing. One end of the latch 52 is disposed near the tip of the plug 31 inserted in the connector. The end is formed in a shape that fits into the recess 33 in the plug 31, and is urged away from the plug 31 by a spring 53.

A plunger 54 is also attached to the latch 52, and the end of the latch 52 can be fitted into the recess 33 of the plug 31 by pulling the plunger 54 against the urging force of the spring 53. The plunger 54 can be latched in this state by a latching component (not shown).

The end of the latch 52 can be removed from the recess 33 in the plug 31 by returning the plunger 54 latched by the latching component (not shown).

The rest of the structure in this embodiment is substantially the same as in the first embodiment shown in FIG. 1.

Next, the operation of the embodiment structured as above will be described referring to the flow chart of FIG. 9.

Figure 9:
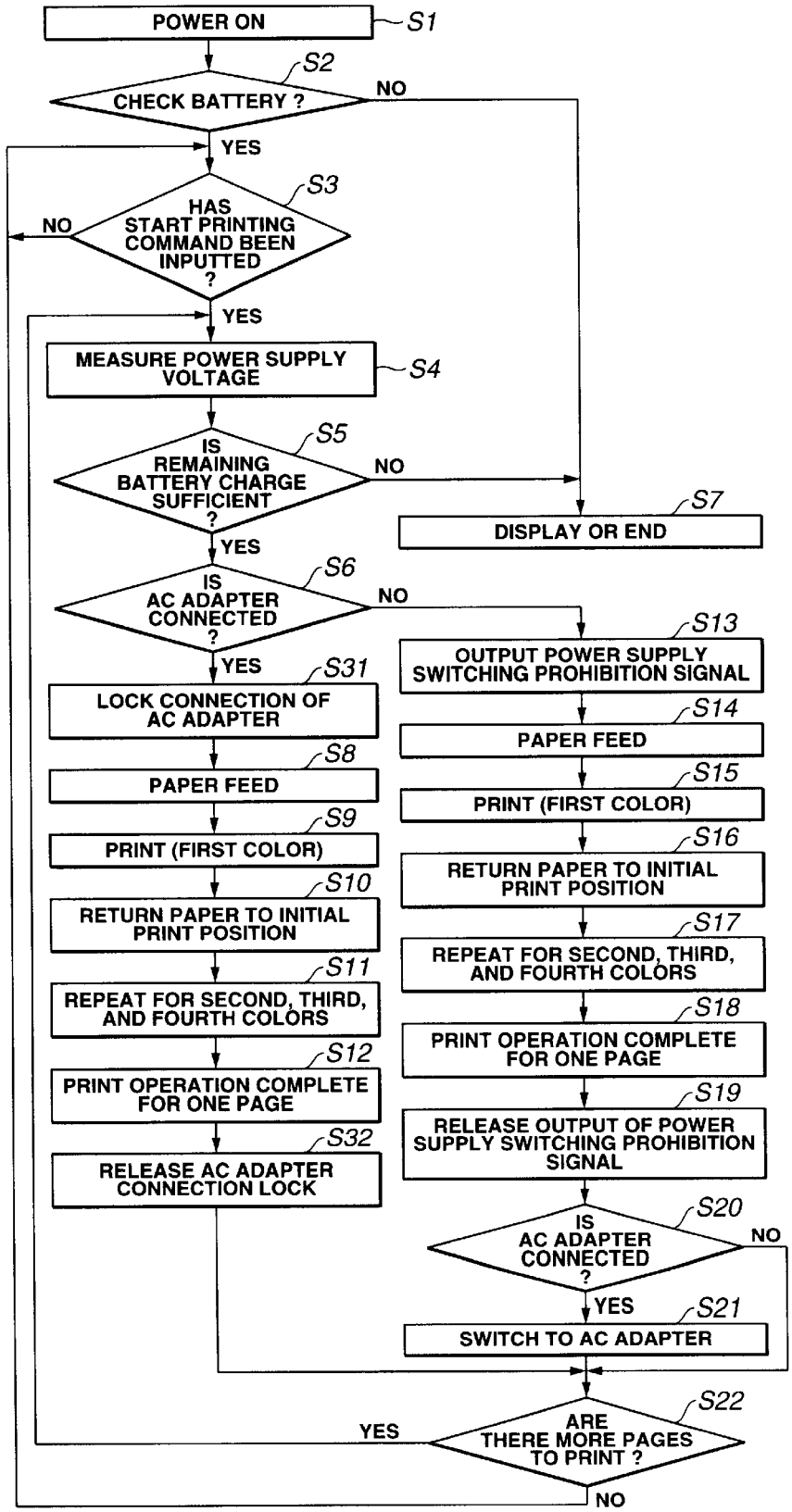
FIG. 9 is a flow chart illustrating the operation in the fourth embodiment.

The operation shown in FIG. 9 is the same as the operation shown in the flow chart of FIG. 5, except that steps S31 and S32 are added. Specifically, when the AC adapter 3 is connected at the start of printing, the flow moves from step S6 to step S31, and the connection of the AC adapter is locked. In other words, prior to the start of printing, the plunger 54 in FIG. 8 is pulled and latched onto the latching component (not shown), and the latch 52 is fitted into the recess 33 in the plug 31. This prevents the plug 31 of the AC adapter 3 from coming out of the connector of the printer housing.

Next, when a print operation is completed for one page through the processing in steps S8 to S12, the connection of the AC adapter is unlocked in step S32. In other words, the plunger 54 is unlatched, and the urging force of the spring 53 removes the latch 52 from the recess 33 in the plug 31. As a result, the plug 31 is free to be inserted into or removed from the connector.

The rest of the operation is the same as in the second embodiment.

Thus, in this embodiment, the AC adapter can be inserted or removed after every print operation even during continuous printing. Here again, the power supply is not switched until the printing of one page is completed, so it is possible to prevent marked changes in print density and the resulting drop in print quality.

It is obvious in the present invention that different embodiments can be constituted on the basis of the present invention without deviating from the scope and essence of the invention. Other than being limited by the appended claims, the present invention is not restricted by the specific embodiments thereof.

What is claimed is:

1. A printer device, comprising:

a thermal head which prints images on paper on the basis of image data;

a power supply switching component which switches a power supply input from a battery power supply and an AC adapter and applies this input to the thermal head; and a controller which, once a print operation with the thermal head has been commenced by switching the power supply switching component so that electrical power supplied from the battery power supply is applied to the thermal head, prohibits the switching of the power supply input by the power supply switching component until the print operation is completed, even if the AC adapter is connected in the midst of the printing of one page.

2. The printer device according to claim 1, wherein the voltage supplied from the battery power supply is substantially equal to the voltage supplied from the AC adapter, and the power supply switching component is constituted by a relay.

3. A printer device, comprising:

a thermal head which prints images on paper on the basis of image data;

a power supply switching component which switches a power supply input from a battery power supply and an AC adapter and applies this input to the thermal head; and a controller which, once a print operation with the thermal head has been commenced by switching the power supply switching component so that electrical power supplied from the battery power supply is applied to the thermal head, controls the power supply switching component such that the power supply input is switched from the battery power supply to the AC adapter upon completion of the print operation if the AC adapter is connected in the midst of the printing of one page.

4. The printer device according to claim 1, wherein the prohibition by the controller of the switching of the power supply input by the power supply switching component is released upon completion of the print operation for one page.

5. The printer device according to claim 4, wherein the voltage supplied from the battery power supply is substantially equal to the voltage supplied from the AC adapter, and the power supply switching component is constituted by a relay.

6. The printer device according to claim 3, wherein the voltage supplied from the battery power supply is substantially equal to the voltage supplied from the AC adapter, and the power supply switching component is constituted by a relay.

7. A printer device, comprising:

a battery power supply;

an AC adapter;

a thermal head which prints images on paper on the basis of image data;

a power supply switching component which switches a power supply input from the battery power supply and the AC adapter and applies this input to the thermal head; and a controller which, once a print operation with the thermal head has been commenced by switching the power supply switching component so that electrical power supplied from the battery power supply is applied to the thermal head, prohibits the switching of the power supply input by the power supply switching component until the print operation is completed, even if the AC adapter is connected in the midst of the printing of one page.

8. The printer device according to claim 7, wherein the prohibition by the controller of the switching of the power supply input by the power supply switching component is released upon completion of the print operation for one page.

9. The printer device according to claim 7, wherein the voltage supplied from the battery power supply is substantially equal to the voltage supplied from the AC adapter, and the power supply switching component is constituted by a relay.

10. The printer device according to claim 7, wherein the voltage of the input power supply is measured at least just after a print start command is inputted and just prior to the start of the print operation.

11. The printer device according to claim 10, wherein the controller determines on the basis of the result of measuring the voltage of the input power supply whether the remaining battery capacity is sufficient to perform the print operation, and controls on the basis of this voltage measurement result the ON time of the heating elements of the thermal head.

12. The printer device according to claim 11, wherein the controller determines on the basis of the result of measuring the voltage of the input power supply whether the remaining battery capacity is sufficient to perform the print operation, and controls on the basis of this voltage measurement result the ON time of the heating elements of the thermal head.

13. The printer device according to claim 7, wherein the voltage of the input power supply is only measured just after a print start command is inputted and just prior to the start of the print operation, during the time from the input of a print start command to the completion of the printing of one page.

14. A printer device, comprising:

a battery power supply;

an AC adapter;

a thermal head which prints images on paper on the basis of image data;

a power supply switching component which switches a power supply input from a battery power supply and an AC adapter and applies this input to the thermal head; and a controller which, once a print operation with the thermal head has been commenced by switching the power supply switching component so that electrical power supplied from the battery power supply is applied to the thermal head, controls the power supply switching component such that the power supply input is switched from the battery power supply to the AC adapter upon completion of the print operation if the AC adapter is connected in the midst of the printing of one page.

15. The printer device according to claim 14, wherein the prohibition by the controller of the switching of the power supply input by the power supply switching component is released upon completion of the print operation for one page.

16. The printer device according to claim 14, wherein the voltage supplied from the battery power supply is substantially equal to the voltage supplied from the AC adapter, and the power supply switching component is constituted by a relay.

17. The printer device according to claim 14, wherein the voltage of the input power supply is measured at least just after a print start command is inputted and just prior to the start of the print operation.

18. The printer device according to claim 17, wherein the controller determines on the basis of the result of measuring the voltage of the input power supply whether the remaining battery capacity is sufficient to perform the print operation, and controls on the basis of this voltage measurement result the ON time of the heating elements of the thermal head.

19. The printer device according to claim 18, wherein the controller determines on the basis of the result of measuring the voltage of the input power supply whether the remaining battery capacity is sufficient to perform the print operation, and controls on the basis of this voltage measurement result the ON time of the heating elements of the thermal head.

20. The printer device according to claim 14, wherein the voltage of the input power supply is only measured just after a print start command is inputted and just prior to the start of the print operation, during the time from the input of a print start command to the completion of the printing of one page.

* * * * *